United States Patent [19]

Mori et al.

[11] Patent Number: 4,642,429

[45] Date of Patent: Feb. 10, 1987

[54] SWITCH

[75] Inventors: Teijiro Mori, Nishinomiya; Yuichi Wada, Kawanishi; Yuji Sako, Kasugai; Hiroaki Tazawa, Nagoya; Hiroyuki Okado, Owariasahi, all of Japan

[73] Assignee: Mitsubishi Denki Kabushiki Kaisha, Tokyo, Japan

[21] Appl. No.: 629,833

[22] PCT Filed: Nov. 4, 1983

[86] PCT No.: PCT/JP83/00397

§ 371 Date: Jul. 2, 1984

§ 102(e) Date: Jul. 2, 1984

[87] PCT Pub. No.: WO84/02033

PCT Pub. Date: May 24, 1984

[30] Foreign Application Priority Data

| | | | |
|---|---|---|---|
| Nov. 10, 1982 | [JP] | Japan | 57-197058 |
| Nov. 10, 1982 | [JP] | Japan | 57-197061 |
| Dec. 3, 1982 | [JP] | Japan | 57-212272 |
| Dec. 3, 1982 | [JP] | Japan | 57-212275 |
| Dec. 3, 1982 | [JP] | Japan | 57-212276 |
| Dec. 3, 1982 | [JP] | Japan | 57-212277 |
| Dec. 3, 1982 | [JP] | Japan | 57-212281 |
| Dec. 3, 1982 | [JP] | Japan | 57-212282 |
| Dec. 24, 1982 | [JP] | Japan | 57-229545 |

[51] Int. Cl.[4] ..... H01H 33/08

[52] U.S. Cl. ..... 200/144 R; 200/147 R

[58] Field of Search ..... 200/144 R, 147 R; 335/201

[56] References Cited

U.S. PATENT DOCUMENTS

| | | | |
|---|---|---|---|
| 4,258,345 | 3/1981 | Malick | 335/201 |
| 4,266,210 | 5/1981 | Mrenna et al. | 335/201 |

FOREIGN PATENT DOCUMENTS

| | | | |
|---|---|---|---|
| 2916276 | 10/1980 | Fed. Rep. of Germany . | |
| 57-90516 | 5/1982 | Japan . | |
| 57-90517 | 5/1982 | Japan . | |
| 224177 | 1/1969 | Switzerland | 200/147 R |

*Primary Examiner*—Robert S. Macon

*Attorney, Agent, or Firm*—Robert E. Burns; Emmanuel J. Lobato; Bruce L. Adams

[57] ABSTRACT

A switch characterized by a stationary contact element joined to a stationary contact, a movable contact element joined to a movable contact in a facing relationship to said stationary contact element, a first metallic arc extinguishing plate formed of a U-shaped vertical wall and disposed with its open end facing toward a tip of said stationary contact and which surround said stationary contact element, and a second metallic arc extinguishing plate disposed in parallel to and at the remote side from said contact elements of said first metallic arc extinguishing plate, said first metallic arc extinguishing plates being disposed at predetermined gaps relative to said stationary contact.

12 Claims, 26 Drawing Figures

SWITCH

TECHNICAL FIELD

This invention relates to switches for interrupting or allowing an electric current to flow, and more particularly to arc extinguishing mechanisms for such switches.

TECHNICAL BACKGROUND

Switches to which the present invention is applicable include electromagnetic contactors and wiring interrupters.

First, one example of a conventional electromagnetic contactor will be described with reference to FIG. 1. In FIG. 1, (1) is a mount bed molded of a plastic material, (2) is a stationary iron core having silicon steel laminations disposed on the mount bed, (3) is a movable core disposed in a facing-relationship with the stationary core (2) and made of silicon stel laminations, (4) is an operating coil for providing a driving force which attracts the movable core (3) to the stationary core (2) against the force of a trip spring (not shown), and (5) is a cross bar made of a plastic material and having a rectangular window, the bottom end of the crossbar (5) has attached thereto the movable core (3). (6) is a movable contact inserted within the rectangular window of the cross bar (5) and held under pressure by a compression spring (7), (6A) is a movable contact element disposed on the movable contact, (8) is a stationary contact facingly disposed with respect to the movable contact (6) for conducting a current (8A) is a stationary contact element disposed on the stationary contact (8), and (8C) is a terminal portion for the stationary contact (8).

Also, (9) is a terminal screw for connecting the electromagnetic contactor main body to an external circuit, (10) is a base for mounting the stationary contact (8), and (11)is a cover for covering the upper portion of the electromagnetic contactor.

Since the conventional electromagnetic contactor has the above-described structure, when the operating coil (4) is de-energized, an unillustrated trip spring causes the movable core (3) to separate from the stationary core (2) and the cross bar (5) occupies the position shown in FIG. 1, and the movable contact element (6A) and the stationary contact element (8A) are separated to generate an electric arc (12), the arc (12) being extinguished at the zero current point to interrupt the electric current.

In the conventional electromagnetic contactor, as shown in FIG. 2, the arc (12) is subjected to a driving force $F_2$ due to a magnetic field formed by a current I flowing through the movable contact (6) and a driving force $F_1$ due to a magnetic field formed by a current I flowing through the stationary contact (8). Since the driving forces $F_1$ and $F_2$ are substantially equal in intensity and opposite in direction, the arc (12) stays on the movable contact element (6A) and the stationary contact element (8A). Thus, since the arc (12) is not forcedly driven, the legs of the arc do not move outside of the contact elements and a thereby resulting in the disadvantage that a large contact element wear occurs;

DISCLOSURE OF THE INVENTION

With the above points in view, the present invention has as its main object to provide an arc extinguishing mechanism for promoting the arc extinction by a quick transfer of the arc, thereby to reduce the contact element wear and to improve the interrupting capability, and the invention is characterized by a stationary contact element jointed on a stationary contact, a movable contact element jointed on a movable contact and disposed in a facing relationship with the stationary contact element, a first metallic arc extinguishing plate comprised of a U-shaped vertical wall, the wall being disposed to surround the stationary contact element with an open side faced toward a tip of the stationary contact, and a second metallic plate disposed in parallel to and at a side of the first metallic arc extinguishing plate remote from each of the contact elements, the first and second metallic arc extinguishing plates being positioned with a predetermined gap therebetween and from the stationary contact.

According to the present invention, an advantage of significantly improving the interrupting capability is obtained by providing in a facing relationship the first U-shaped metallic arc extinguishing plate and the parallel second metallic arc extinguishing plate.

BEST MODE FOR WORKING THE INVENTION

Figure 1:
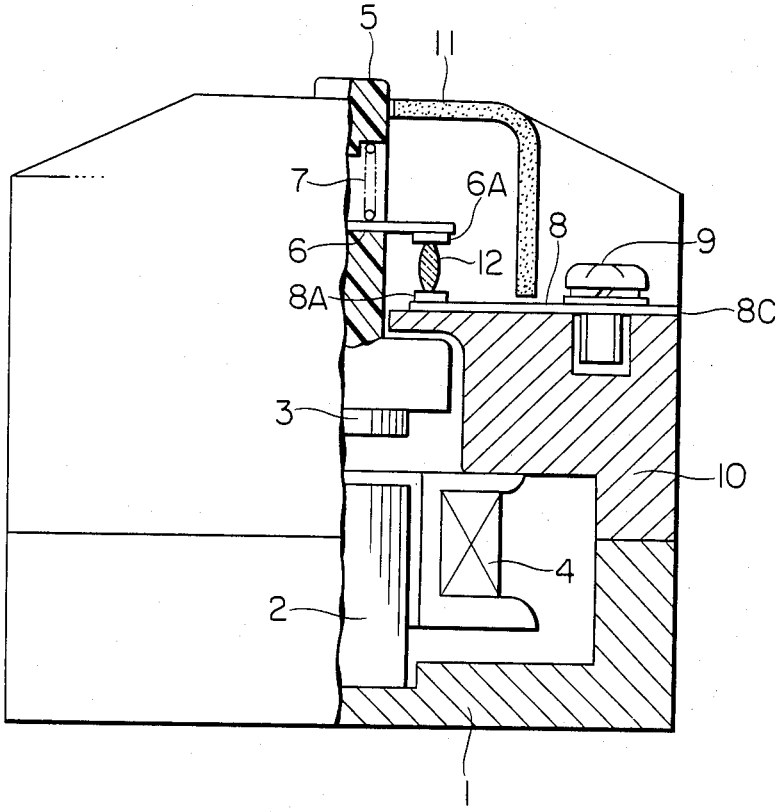
FIG. 1 PRIOR ART
FIG. 1 is a partial sectional view of a switch of a conventional design.
Figure 2:
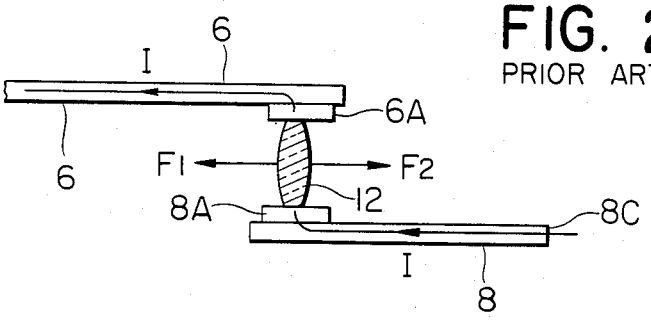
FIG. 2 PRIOR ART
FIG. 2 is an explanatory view showing the contact element arrangement of the switch shown in FIG. 1.
Figure 3:
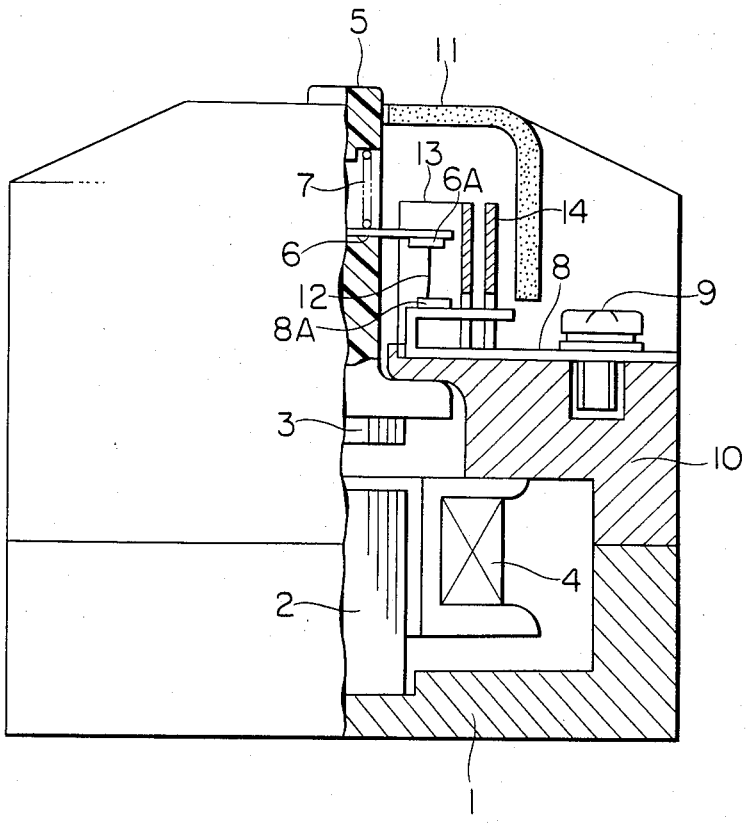
FIG. 3 is a partial sectional view of a switch of an embodiment of the present invention.
Figure 4:
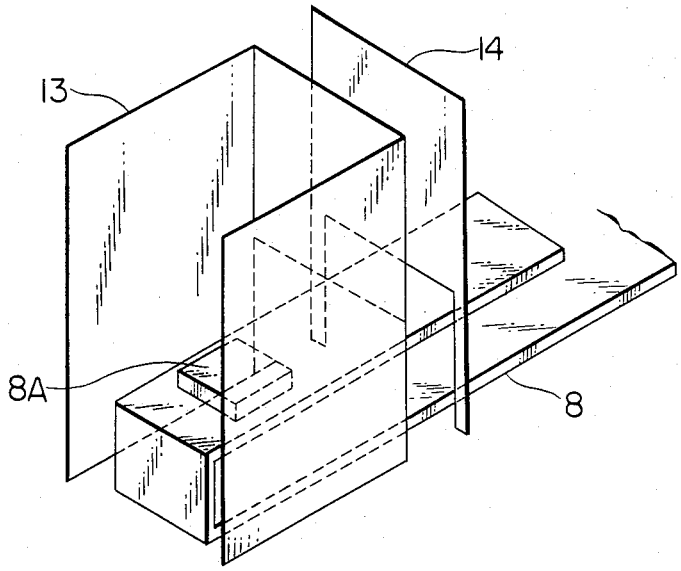
FIG. 4 is an enlarged view of a main portion of the arc extinguishing chamber shown in FIG. 3.

The present invention will now be described in conjunction with an embodiment shown in FIGS. 3 to 5. As clearly seen from FIG. 3, the switch of this embodiment is different from the conventional switch primarily in the arc extinguishing mechanism and this mechanism is shown in an enlarged view in FIG. 4. As shown in FIG. 4, within an arc extinguishing chamber shown in FIG. 3 are disclosed a first metallic arc extinguishing member or plate (13) and a second metallic arc extinguishing member or plate (14) made of a magnetic material for extinguishing an electric arc (12) established between a stationary contact element (8A) and a movable contact element (6A). As shown, the stationary contact element (8A) is joined to the stationary contact (8) at a location spaced from the free disal end thereof. The first metallic arc extinguishing member (13) has a pair of opposed sidewall portions interconnected by a third sidewall portion to form a generally U-shaped frame bridging across the stationary contact (8) to partly enclose the stationary contact element (8A), and the second metallic arc extinguishing member (14) has a sidewall portion positioned in parallel to and outside of the first metallic arc extinguishing plate (13) to bridge thereacross.

Figure 8:
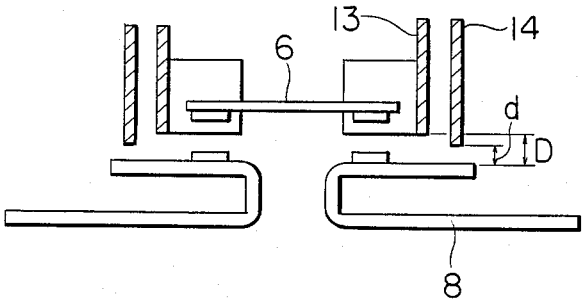
FIG. 8 is an overall explanatory view of the arc extinguishing chamber shown in FIG. 3.
Figure 9:
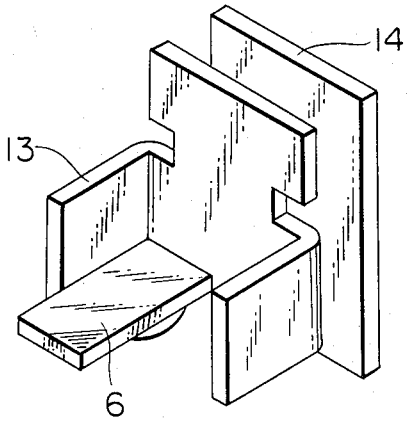
FIG. 9 is a partial perspective view showing a modification of the arc extinguishing plate.

The first metallic arc extinguishing plate (13) and the second metallic arc extinguishing plate (14) are positioned with a predetermined gap between them and the stationary contact (8), and a gap (d) formed between the second metallic arc extinguishing plate (14) and the stationary contact (8) is selected to be smaller than a gap (D) formed between the first metallic arc extinguishing plate (13) and the stationary contact (8) as seen from FIG. 8. Also, the first metallic arc extinguishing plate (13) is constructed in order that its three sides surrounding each contact element promote the drawing of the arc while shielding the surrounding insulating material from being damaged by the arc, and the first metallic arc extinguishing plate (13) may be selected to have a suitable U-shape taking heat dissipating effect into consideration as in the one shown in FIG. 9, for example.

With the above arrangement, when the operating coil (4) of this electromagnetic contactor is de-energized, the unillustrated trip spring separates the movable core (3) from the stationary core (2) and the cross bar (5) occupies the position shown in FIG. 3 to separate the stationary contact element (8A) and the movable contact element (6A) to generate the electric arc (12) between the stationary contact element (8A) and the movable contact element (6A). This arc (12) is extinguished at the current zero point by the first metallic arc extinguishing plate (13) and the second metallic arc extinguishing plate (14), as explained below, thereby inetrrupting the electric current.

This extinguishing process of the arc (12) will now be described in more detail in conjunction with FIG. 5 in which a section of the arc extinguishing chamber is shown. The arc (12) drawn between the movable contact element (6A) and the stationary contact element (8A) is attracted by the first metallic arc extinguishing plate (13) made of a magnetic material and is expanded as shown by an electric arc (12A). At this time, since the stationary contact (8) is in the form of a U-shaped cross-section as shown in FIG. 4, the arc (12) is rapidly attracted and driven by a magnetic field formed by a current flowing through the stationary contact (8), whereby the arc (12) is further elongated. When the arc (12) is thus elongated, the arcing voltage increases. Therefore, dielectric breakdown occurs between the stationary contact (8) and the first metallic arc extinguishing plate (13), and between the first metallic arc extinguishing plate (13) and the movable contact element (6A), so that the arc (12A) is divided into two arcs (12B) and (12C). The divided arc (12C) is attracted by the second metallic arc extinguishing plate (14) and driven by the magnetic field formed by the current through the stationary contact (8), whereby the arc is expanded as shown by an arc (12D). When the arcing voltage is increased due to this expansion of the arc (12D), the arc (12D) is further divided into two arcs (12E) and (12F) and the arc is ultimately divided into three arcs (12B), (12E) and (12F) which are extinguished at the current zero point, thus interrupting the electric current.

Thus, according to the above-described switch, since the first metallic arc extinguishing plate (13) is constructed as a vertically disposed U-shaped frame surrounding the movable contact element (6A), a magnetic field due to the surrounding three walls promotes the magnetic driving of the arc, and the damage to the surrounding insulating material is minimized. Further, since the first metallic arc extinguishing plate (13) and the second metallic arc extinguishing plate (14) are disposed in parallel, the arc is progressively divided as described above, thereby increasing the arc extinguishing capability. When the gap (d) between the second metallic arc extinguishing plate (14) and the stationary contact (8) is selected to be smaller than the gap (D) between the first metallic arc extinguishing plate (13) and the stationary contact (8), the arc is prevented from remaining on the first metallic arc extinguishing plate (13), enabling further promotion of the arc dividing effect previously described.

Figure 6:
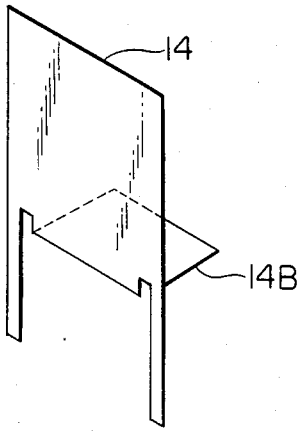
FIG. 6 is a perspective view showing the second metallic arc extinguishing plate of another embodiment of the present invention.
Figure 7:
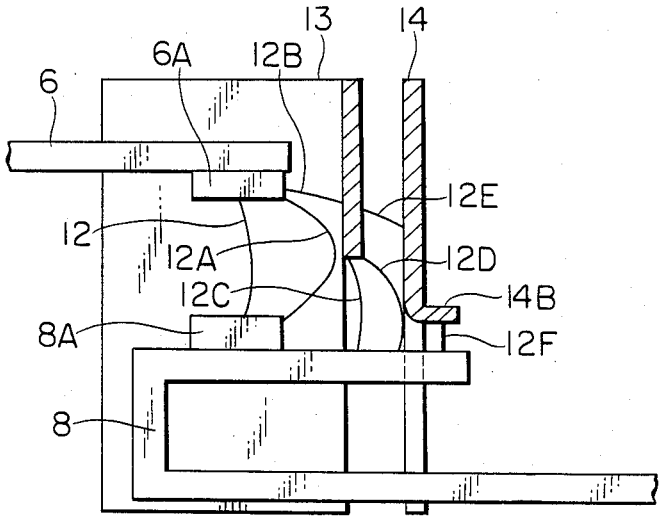
FIG. 7 is an explanatory view showing the arc extinguishing operation of the arc extinguishing plate shown in FIG. 6.

As shown in FIGS. 6 and 7, a lower edge of the second metallic arc extinguishing plate (14) may be folded toward the arc driving-direction to form an arc lead portion (14B). With this arrangement, since an arc (12F) moves along the arc lead portion (14B) as shown in FIG. 7, an electric field concentration on the second metallic arc extinguishing plate (14) due to the stay or dwell of one end of the arc (12F) seldom occurs, and since the arc extinction is achieved on the arc lead portion (14B) which is a flat surface portion having a good thermal conductivity, burning is prevented, thereby providing a superior interrupting capacity.

While the arc extinction by the switch described above is achieved as shown in FIG. 5, if the lower edges of the first metallic arc extinguishing plate (13) and the second metallic arc extinguishing plate (14) which oppose the stationary contact (8) are positioned on substantially the same horizontal planes, it has been found to be disadvantageous in that the second metallic arc extinguishing plate (14) does not provide a sufficient attracting function with respect to the arc (12C), resulting in an insufficient elongation of the arc (12C) which allows the arc to stay as it is to lengthen the arcing time.

The description will be made as to an embodiment for overcoming the above-mentioned disadvantage.

Figure 10:
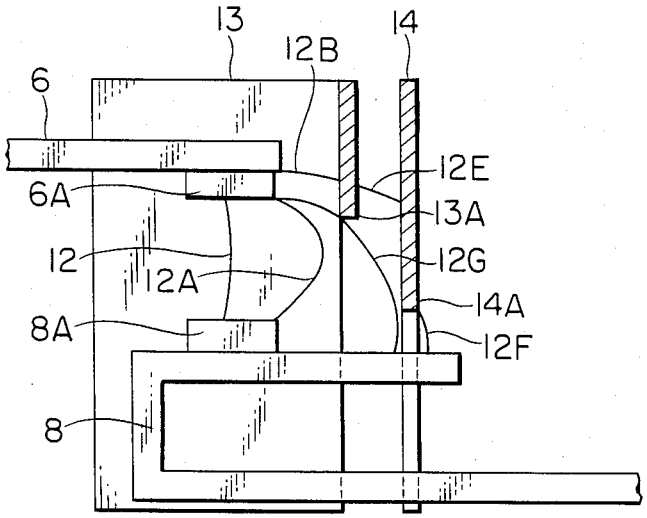
FIG. 10 is an explanatory view showing the arc extinguishing operation of another embodiment of the present invention.

A modified embodiment of the present invention will be described in conjunction with FIG. 10, in which a lower edge (13A) of the first metallic arc extinguishing plate (13) opposed to the stationary contact (8) is positioned on substantially the same plane in which the contact surface of the movable contact element (6A) in the open position lays, and the lower edge (14A) of the second metallic arc extinguishing plate (14) is positioned so that the gap between the lower edge (14A) and the stationary contact (8) is less than one half of the gap between the lower edge (13A) and the stationary contact (8), and is preferably about 1 to 2 mm.

In the arc extinguishing mechanism constructed as described above, the arc (12) generated between the movable contact element (6A) and the stationary contact element (8A) is drawn toward the first metallic arc extinguishing plate (13) made of a magnetic material to be elongated as shown by the arc (12A). The arc (12A) is then driven by a magnetic field formed by the electric current flowing through the stationary contact (8) which is U-shaped as shown, and the lower leg of the arc (12A) is moved in the righward direction as viewed in the figure along the surface of the stationary contact (8). Since the end face (13A) of the first metallic arc extinguishing plate (13) is at substantially the same level as the surface of the movable contact element (6A), and since the end face (14A) of the second metallic arc extinguishing plate (14) is positioned at a distance from the stationary contact (8) less than one half of the gap between the above end face (13A) and the stationary contact (8), a circularly bent portion of an arc (12G), which is an arc formed with the legs of the lower arc (12A) moved to the right and elongated, substantially simultaneously contacts at two points with the first metallic arc extinguishing plate (13) and the second metallic arc extinguishing plate (14), the arc (12G) being divided into three arcs (12B), (12E) and 12F), resulting in a high arcing voltage which causes the interruption at the current zero point.

Figure 5:
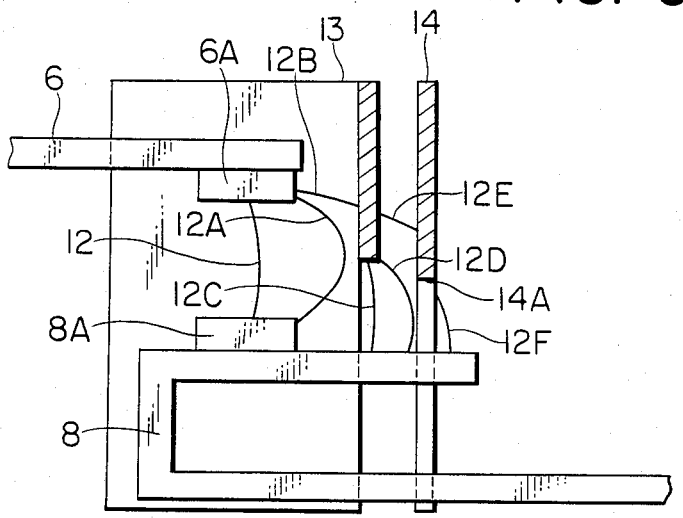
FIG. 5 is a view for explaining the arc extinguishing function of the chamber shown in FIG. 4.

Thus, since the phenomenon in which the arc (12C) stays at the end face of the first metallic arc extinguishing plate (13) as in the arrangement shown in FIG. 5 is prevented, the interrupting operation of the just above described arrangement is very stable and the arrangement provides a very high interrupting capacity.

As above described, with this arrangement, the distances of the first metallic arc extinguishing plate and the second metallic arc extinguishing plate from the stationary contact are selected in a particular relationship, and the interrupting capacity is significantly advantageously improved.

Figure 11:
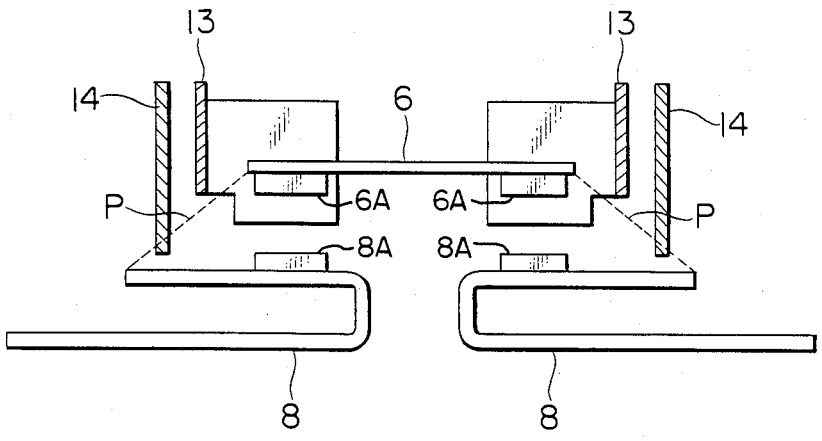
FIG. 11 is an overall schematic view showing the arc extinguishing chamber of still another embodiment.
Figure 12:
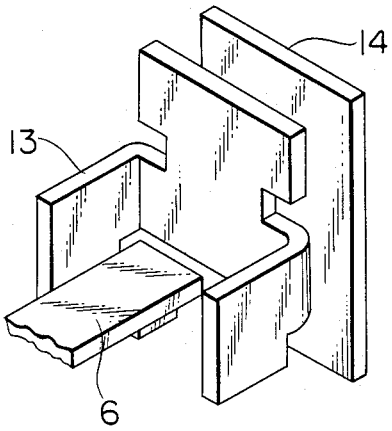
FIG. 12 is a perspective view showing a partially modified embodiment of the arc extinguishing chamber.

FIG. 11 shows still another embodiment of the present invention, in which the lower edge of the first metallic arc extinguishing plate (13) facing the stationary contact (8) is positioned above an imagenary line (P) extending between a tip of the movable contact (6) in the open position and the tip of an arc runner formed in a portion, of the stationary contact (8) which carries the stationary contact element 8A. As shown, the lower edge of the second metallic arc extinguishing plate (14) is positioned below the above line (P) and faces the stationary contact (8). Also, the first metallic arc extinguishing plate (13) is arranged to increase the attractive force on the arc due to the three sides of the plate (13) surrounding the respective contact elements and to protect the surrounding insulations, and a U-shape as shown in FIG. 12 may be selected taking the heat dissipation into consideration.

Figure 13:
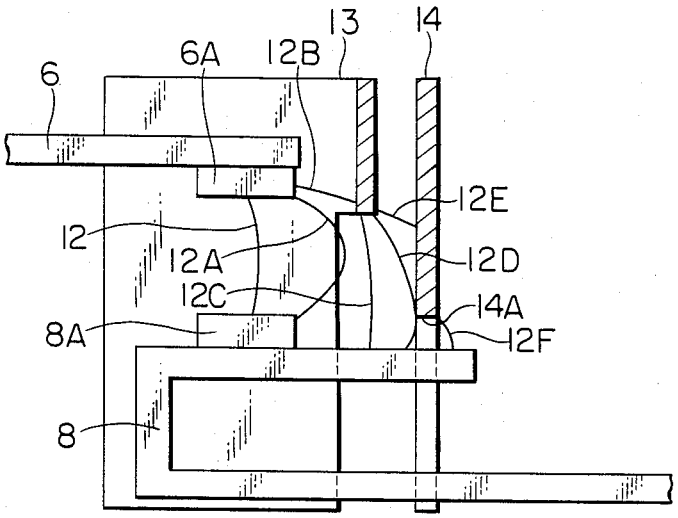
FIG. 13 is a view for explaining the arc extinguishing operation of the embodiment shown in FIG. 11.
Figure 14:
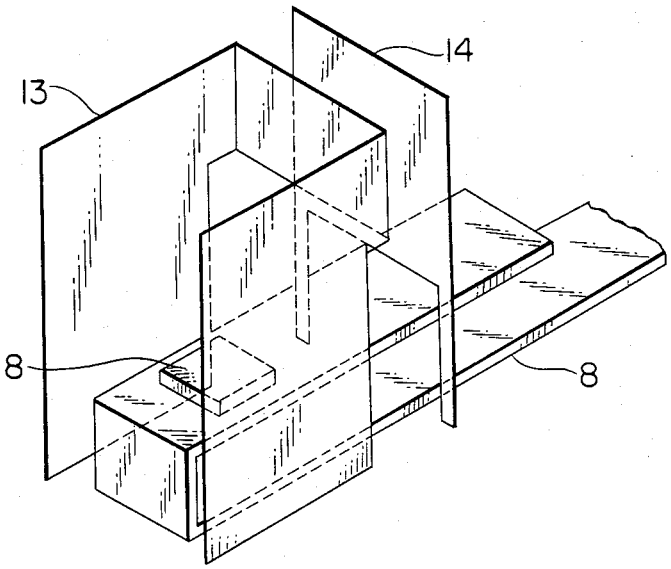
FIG. 14 is an enlarged view of the arc extinguishing chamber of the embodiment shown in FIG. 11.

The process of the arc extinction will be described in more detail in conjunction with FIG. 13. The arc (12) generated between the movable contact element (6A) and the stationary contact element (8A) is drawn by the first metallic arc extinguishing plate (13) made of a magnetic material to be extended to become the elongated arc (12A). Since the stationary contact (8) has a U-shaped cross-section as shown in FIG. 14, the arc (12) is rapidly attracted and driven by the magnetic field formed by a current flowing through the stationary contact (8) to be further extended. Since the arcing voltage increases as the arc (12) expands, dielectric breakdowns occur between the stationary contact (8) and the first metallic arc extinguishing plate (13), and between the first metallic arc extinguishing plate (13) and the movable contact element (6A), and the arc (12A) is divided into two arcs (12B) and (12C). The divided arc (12C) is attracted by the second metallic arc extinguishing plate (14) and driven by the magnetic field formed by a current flowing through the stationary contact (8) to be expanded as shown by an electric arc (12D). As the arc (12D) is expanded, the arcing voltage increases and the arc (12D) is further divided into two arcs (12E) and (12F). Thus, the arc (12) is ultimately divided into three arcs (12B), (12E) and (12F) and extinguished at the current zero point, thereby interrupting the current.

According to the above described switch, since the first metallic arc extinguishing plate (13) is a U-shaped frame vertically disposed around the movable contact element (6A), the driving and attraction of the arc is promoted by the magnetic field formed by the surrounding three side walls and damage to the surrounding insulations is minimized. Also, since the first metallic arc extinguishing plate (13) and the second metallic arc extinguishing plate (14) are disposed in parallel, the arc is divided as previously described and the arc extinguishing capacity is further increased. Moreover, since the lower edges of the first metallic arc extinguishing plate (13) and the second metallic arc extinguishing plate (14) are positioned above and below the previously-mentioned line (P), the arc is prvented from staying or dwelling at the lower edge of the first metallic arc extinguishing plate (13) and obstructing the proper functioning of the second metallic arc extinguishing plate (14), thereby promoting the previously-described arc dividing function.

As shown in FIG. 6, the second metallic arc extinguishing plate (14) may be provided with an arc lead portion (14B) formed by folding the lower edge thereof toward the arc driving direction.

As has been described, according to this embodiment, the U-shaped first metallic arc extinguishing plate (13) and the parallel second metallic arc extinguishing plate (14) are disposed in a facing relationship to the movable contact element and in a particular lower edge position, and the advantage of significantly increasing the interrupting capacity is obtained.

Figure 15:
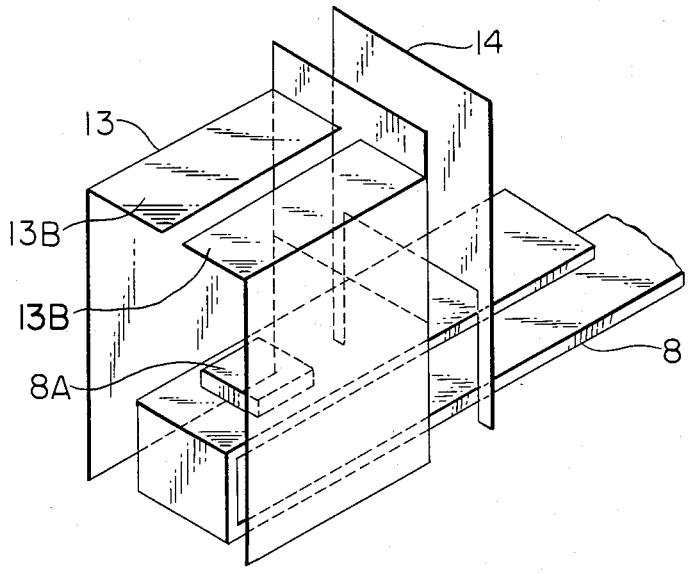
FIG. 15 is an enlarged view of the arc extinguishing chamber of another embodiment.
Figure 16:
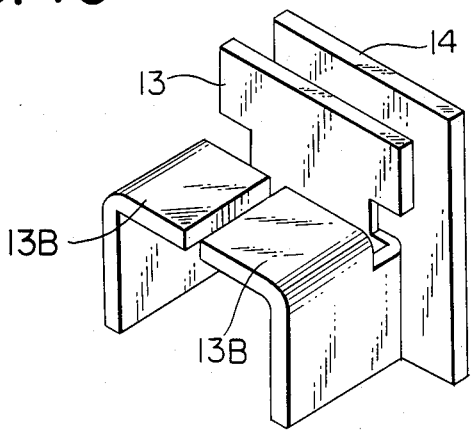
FIG. 16 is a perspective view showing a partially modified embodiment of the embodiment shown in FIG. 15.

FIG. 15 illustrates still another embodiment of the present invention. In the figure, the first metallic arc extinguishing plate (13) is provided with shield tongues (13B) facing the back side of the movable contact element (6A). The U-shape of the first metallic arc extinguishing plate (13) may be selected with the heat dissipation taken into consideration as shown in FIG. 16. The gap (d) between the second metallic arc extinguishing plate (14) and the stationary contact (8) of this embodiment is selected to be smaller than the gap (D)

between the first metallic arc extinguishing plate (13) and the stationary contact (8).

In this embodiment, the first metallic arc extinguishing plate (13) is provided with the shield tongues (13B) in facing relationship with the back face of the movable contact element (6A), so that the insulating wall in an upper position or at the back side of the movable contact element (6A) is prevented from being deteriorated by the heat of the arced gas.

As in the embodiment shown in FIG. 6, the lower edge of the second metallic arc extinguishing plate (14) may be folded toward the arc driving direction to form the arc lead portion (14B).

Figure 17:
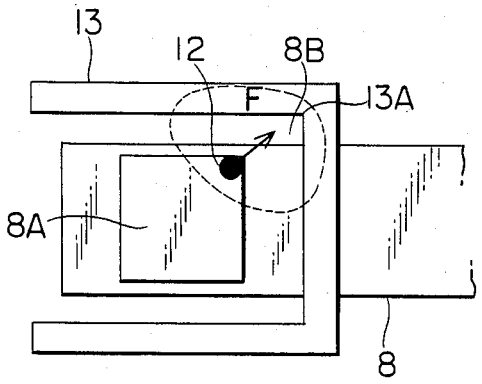
FIGS. 17 and 18 are enlarged views showing the manner in which the arc moves in the arc extinguishing chamber.
Figure 18:
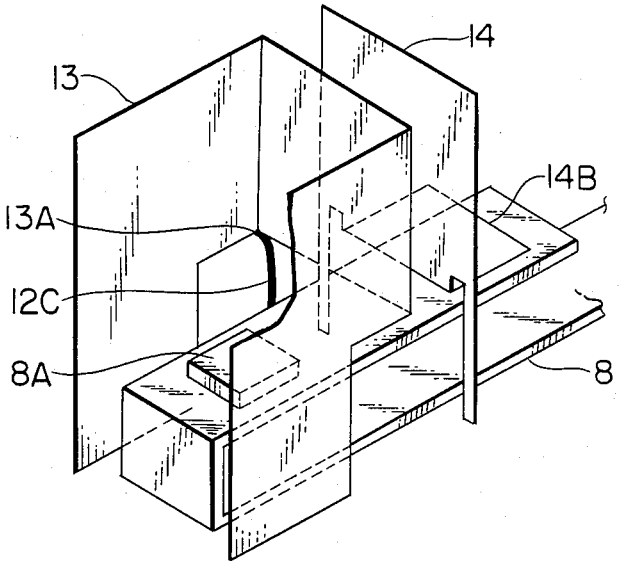

In the switch shown in FIGS. 4 and 5, since a magnetic flux shown in a dashed line in FIG. 17 is generated around the arc (12) on the stationary contact element (8A) due to the presence of the first metallic arc extinguishing plate (13) made of a magnetic material, the arc (12) is subjected to a force F shown in FIG. 17 to be driven toward the corner portion (13A) of the first metallic arc extinguishing plate (13). However, because the spacing between the first metallic arc extinguishing plate (13) and the stationary contact (8) is small, the arc (12C) tends to stay between the corner portion (13A) of the first metallic arc extinguishing plate (13) and the stationary contact (8) as shown in FIG. 18, particularly during small current interruption, and therefore the interrupting capacity is not sufficient for interrupting a high voltage circuit.

The description will be made as to still another embodiment of the present invention for solving the above problem.

Figure 19:
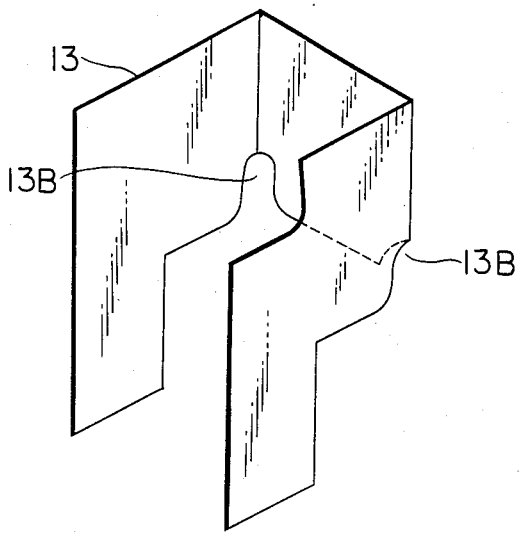
FIG. 19 is a perspective view showing the metallic arc extinguishing plate of another embodiment.
Figure 20:
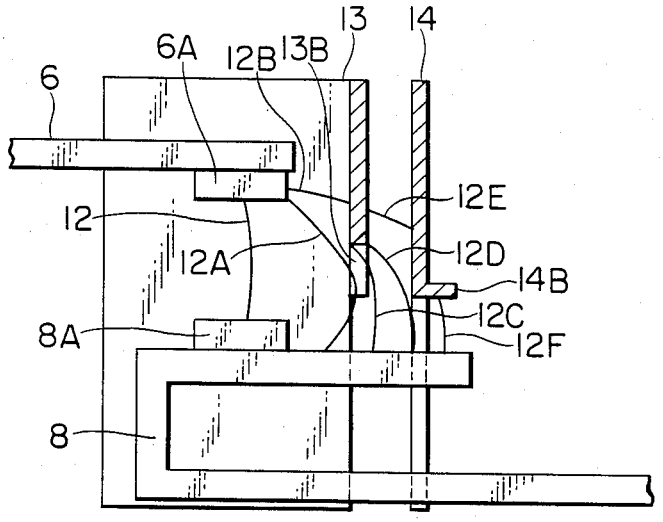
FIG. 20 is an explanatory view showing the arc extinguishing operation of the embodiment shown in FIG. 19.

As shown in FIG. 19, the corner portion (13A) of the first metallic arc extinguishing plate (13) facing the stationary contact is provided with notches (13B), and this embodiment is different from the first embodiment in this respect.

The description will now be made as to the arc extinguishing process in terms of the arc (12) for the embodiment having the first metallic arc extinguishing plate (13) of the above structure. The arc (12) generated between the movable contact element (6A) and the stationary contact element (8A) is attracted by the first metallic arc extinguishing plate (13) to be elongated as shown by the arc (12A). At this time, since the arc (12A) is drawn into the deepest portion of the notches (13B) of the first metallic arc extinguishing plate (13), the arc (12A) becomes longer than that in the embodiment shown in FIG. 5. Therefore, the arcing voltage is correspondingly increased and the dielectric breakdown occurs more quickly than that in the embodiment shown in FIG. 5 between the stationary contact (8) and the first metallic arc extinguishing plate (13) and between the first metallic arc extinguishing plate (13) and the movable contact element (6A), thus more quickly dividing the arc (12A) into two arcs (12B) and (12C). The divided arc (12C) is attracted to the second metallic arc extinguishing plate (14) and driven by a magnetic field formed by a current flowing through the stationary contact (8), and is thus elongated as shown by the arc (12D) which is longer than the corresponding arc shown in the embodiment of in FIG. 5. This longer elongation of the arc (12D) causes the increase of the arcing voltage to divide the arc (12D) into two arcs (12E) and (12F). Thus, the arc (12) is ultimately divided into three arc (12B), (12E) and (12F), the arc (12F) being extinguished between the arc lead portion (14B) of the second metallic arc extinguishing plate (14) and the stationary contact.

According to this embodiment, since the arc extinguishing operation is as described above, the arc (12A) is drawn into the deepest portion of the notches (13B) of the first metallic arc extinguishing plate (13) and the arcing voltage is increased, whereby the arc (12A) can be more easily and quickly divided into two arcs (12B) and (12C). Also, since the corner portions of the folded portion (13A) on the stationary contact side of the first metallic arc extinguishing plate (13), at which the arc tends to stay, are provided with the notches (13B), the length of the arc (12C) is increased and the arcing voltage of the arc (12C) is correspondingly increased. Therefore the arc (12C) is quickly divided into two arcs. As a result, the arc (12C) is prevented from staying at the first metallic arc extinguishing plate (13) and the quick dividing and extinction of the arc (12C) is promoted, thereby providing a superior interrupting capacity. The position and the shape of the notches (13B) are not limited to those shown in FIG. 19.

Figure 21:
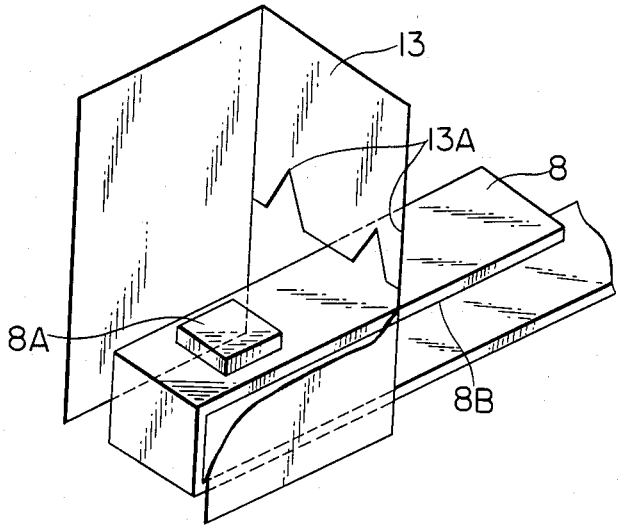
FIGS. 21, 22, 23 and 24 are perspective views showing the metallic arc extinguishing plates of still other embodiments.

As shown in FIG. 21, wedge-shaped notches may be formed in the first metallic arc extinguishing plate (13) on lines (13A) extended from the respective side faces (8B) of the stationary contact (8).

With this embodiment, since the arc is drawn into the deepest portion of the notches of the first metallic arc extinguishing plate (13), the arcing voltage is increased and the arc is easily divided into two arcs. Also, since the length of the arc between the stationary contact (8) and the first metallic arc extinguishing plate (13) increases because of the presence of the notches, which further increases the arcing voltage, the arc is further more easily divided into two arcs. That is, the arc is prevented from staying on the first metallic arc extinguishing plate (13) and is divided into two arcs, ensuring a superior interrupting capacity.

Figure 22:
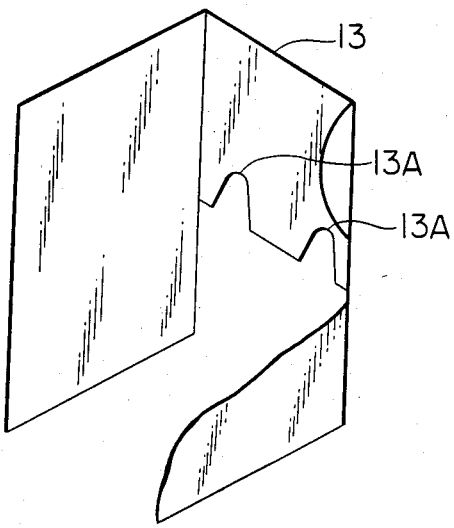
Figure 23:
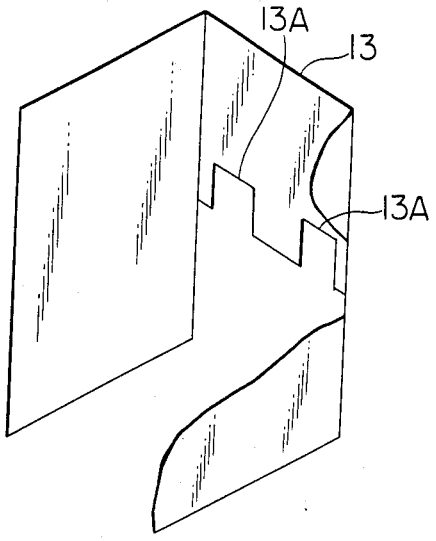

The shape of the notches is not limited to the wedge-shape, and a superior interrupting capacity similar to that obtained by using notches of the wedge-shape can be obtained even with the notches shaped as shown in FIGS. 22 and 23.

Figure 24:
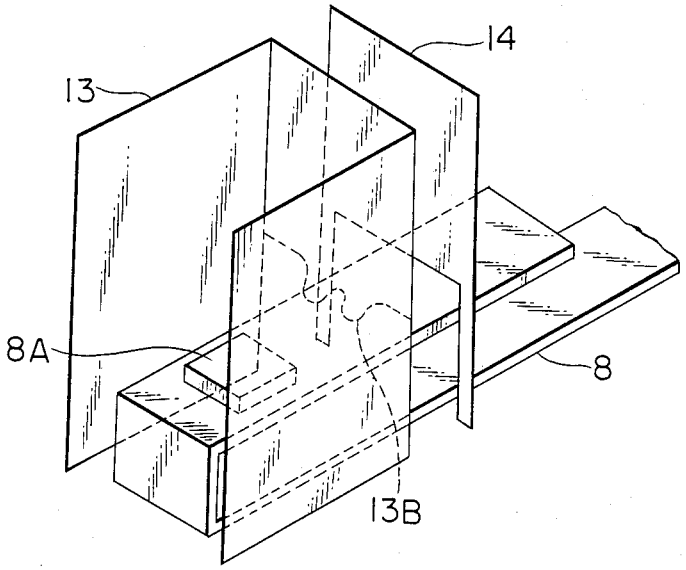

FIG. 24 illustrates a further embodiment of the notches. In the vicninty of the lower edge center of the first metallic arc extinguishing plate (13) are formed proejctions (13C) (13C), which form notches along their sides.

Figure 25:
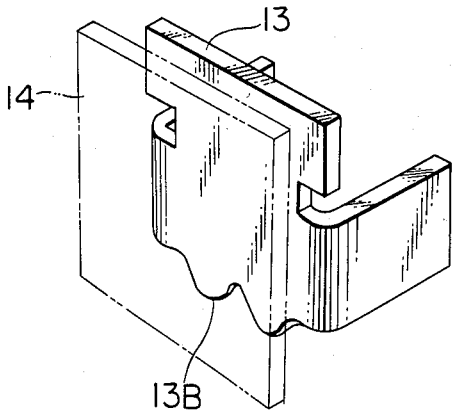
FIG. 25 is a perspective view showing the metallic arc extinguishing plate of a still further embodiment.

The U-shape of the first metallic arc extinguishing plate (13) may be selected to be the one shown in FIG. 25 when considering heat dissipation. Similarly to the embodiment shown in FIG. 8, the gap (d) between the second metallic arc extinguishing plate (14) and the stationary contact (8) is selected to be smaller than the gap (D) between the first metallic arc extinguishing plate (13) and the stationary contact (8).

In this embodiment, since wave-shaped projections (13B) are formed on the lower edge of the first metallic arc extinguishing plate (13), the arc is drawn toward the center by the arc drawing function of the wave-shaped projections (13B) to be extinguished, thus preventing the deterioration of the insulating side walls and the reduction of the arc extinguishing capacity due to the the arc remaining at the arc extinguishing plate side portions, resulting in a more efficient arc dividing and extinguishing operation.

Figure 26:
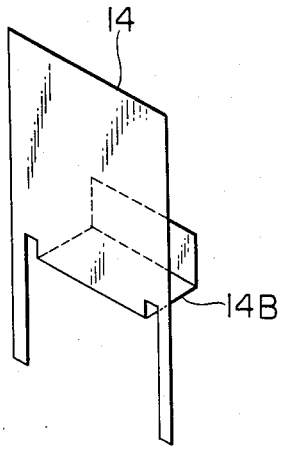
FIG. 26 is a perspective view showing the metallic arc extinguishing plate of another embodiment.

FIG. 26 illustrates a modification of the second metallic arc extinguishing plate (14). The second metallic arc extinguishing plate (14) has formed on its lower edge of the portion bridging over the stationary contact an arc lead portion (14B) folded to form a U-shaped cross section and facing the stationary contact.

With this embodiment, when the arc is divided into two by the second metallic arc extinguishing plate (14), a concentration of an electric field on the second metallic arc extinguishing plate (14) is prevented by the presence of the U-shaped arc lead portion (14B), and the arc is quickly extinguished on the bottom planar surface of the U of the arc lead portion (14B). Also, since the above bottom planar surface is effectively provided with a heat dissipation due to a vertical leg portion of the U, there is no risk of burning, thereby providing a superior interrupting capacity.

Although the stationary contact (8) in all of the above-described embodiment has a U-shape, a quite similar effect can be obtained with a straight shape rather than the U-shape.

Although the description has been made in terms of the embodiments of the present invention applied to switches in which the contacts are operated by a magnet, i.e., electromagnetic contactors, the present invention may equally be applicable to other switches such as wiring interrupters.

What is claimed is:

1. A switch comprising: a housing; a stationary contact stationarily disposed within the housing and having a distal end; a stationary contact element joined to the stationary contact at a location spaced from the distal end thereof; a movable contact mounted to undergo movement in the housing toward and away from the stationary contact; a movable contact element joined to the movable contact for movement therewith and being disposed in opposed facing relation to the stationary contact element; a first metallic arc extinguishing member disposed in the housing and having first and second spaced-apart sidewall portions disposed on opposite sides of the stationary and movable contacts in the region of the stationary and movable contact elements, and a third sidewall portion interconnecting the first and second sidewall portions at a location between the stationary contact element and the distal end of the stationary contact, the third sidewall portion having a gap therein through which extends the distal end portion of the stationary contact; a second metallic arc extinguishing member disposed in the housing and having a sidewall portion spaced from the third sidewall portion of the first metallic arc extinguishing member in the direction of the stationary contact distal end, the sidewall portion of the second metallic arc extinguishing member having a gap therein through which extends the distal end portion of the stationary contact; and wherein the gap spacing between the second metallic arc extinguishing member and the stationary contact is smaller than the gap spacing between the first metallic arc extinguishing member and the stationary contact.

2. A switch as claimed in claim 1; wherein said first and second metallic arc extinguishing members comprise plates.

3. A switch as claim in claim 1; wherein said second metallic arc extinguishing member has an arc lead portion which extends in a direction toward the distal end of said stationary contact.

4. A switch as claimed in claim 3; wherein said arc lead portion faces said stationary contact and is extended and folded into a U-shape in a direction toward the distal end of said stationary contact.

5. A switch as claimed in claim 1; wherein a lower edge of said first metallic arc extinguishing member facing said stationary contact is positioned in the vicinity of an open position of the movable contact element, and the opposing distance between a lower edge of said second metallic arc extinguishing member and the stationary contact is selected to be less than one half of the spacing distance between said first metallic arc extinguishing member and said stationary contact.

6. A switch as claimed in claim 1; wherein a lower edge of said first metallic arc extinguishing member facing said stationary contact is positioned above an imaginary line connecting a tip of the movable contact in the open position and a tip of an arc runner extending at the contact element joining portion of said stationary contact, and a lower edge of said second metallic arc extinguishing member is positioned below said imaginary line to oppose said stationary contact.

7. A switch as claimed in claim 1; wherein the lower edge of said first metallic arc extinguishing member facing said stationary contact is provided with at least one notch.

8. A switch as claimed in claim 7; wherein the corners of said first metallic arc extinguishing member facing said stationary contact and defined by the interconnection of the third sidewall portion with the first and second sidewall portions are provided with notches.

9. A switch as claimed in claim 7; wherein said first metallic arc extinguishing member is provided at positions on lines of extension extended from both side faces of said stationary contact with notches.

10. A switch as claimed in claim 7; wherein said first metallic arc extinguishing member has a projection formed at the central portion of the lower edge thereof, thereby forming notches on both sides of the projection.

11. A switch as claimed in claim 1; wherein said first metallic arc extinguishing member is provided with wave-shaped projections at the lower edge thereof facing said stationary contact.

12. A switch as claimed in claim 1; wherein said first metallic arc extinguishing member is provided with a shielding tongue portion facing the back face of said stationary contact element.

* * * * *